United States Patent [19]

Huffaker et al.

[11] Patent Number: 5,009,382

[45] Date of Patent: Apr. 23, 1991

[54] INSTRUCTION CLIP FOR SEWING MACHINE

[76] Inventors: Almyria Huffaker, 2548 McHenry Rd., Goshen, Ohio 45122; George Spector, 233 Broadway, #3815, New York, N.Y. 10007

[21] Appl. No.: 447,837

[22] Filed: Dec. 8, 1989

[51] Int. Cl.[5] ..... A47B 97/00

[52] U.S. Cl. ..... 248/284; 248/286; 248/316.7; 248/295.1; 248/442.2; 248/298

[58] Field of Search ..... 248/285, 287, 124, 122, 248/121, 188.5, 286, 316.7, 442.2, 283, 295.1, 298; 40/341; 400/718

[56] References Cited

U.S. PATENT DOCUMENTS

| | | | |
|---|---|---|---|
| 573,703 | 12/1896 | Robbins | 248/287 X |
| 646,835 | 4/1900 | Jackson | 248/447.2 |
| 1,302,993 | 5/1919 | Tennant | 400/718 |
| 1,347,471 | 7/1920 | Connors | 248/447.2 X |
| 1,377,230 | 5/1921 | Taylor | 248/447.2 X |
| 1,782,617 | 11/1930 | Huonker | 248/447.2 X |

FOREIGN PATENT DOCUMENTS

| | | | |
|---|---|---|---|
| 225881 | 4/1969 | Sweden | 400/718 |
| 3039 | of 1893 | United Kingdom | 248/285 |

*Primary Examiner*—Karen J. Chotkowski

[57] ABSTRACT

An instruction holder for a sewing machine cabinet is provided and consists of an inverted L-shaped stanchion affixed to a mounting block on rear surface of the sewing machine cabinet. Clips are provided for suspending an instruction sheet on a horizontal arm of the stanchion so that the instruction sheet will extend over the top surface of the sewing machine cabinet allowing hands of a person to be free while sewing.

1 Claim, 1 Drawing Sheet

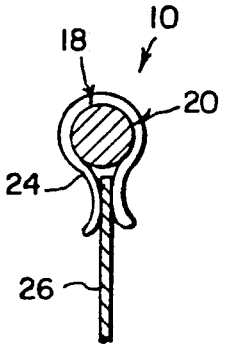
Fig. 2
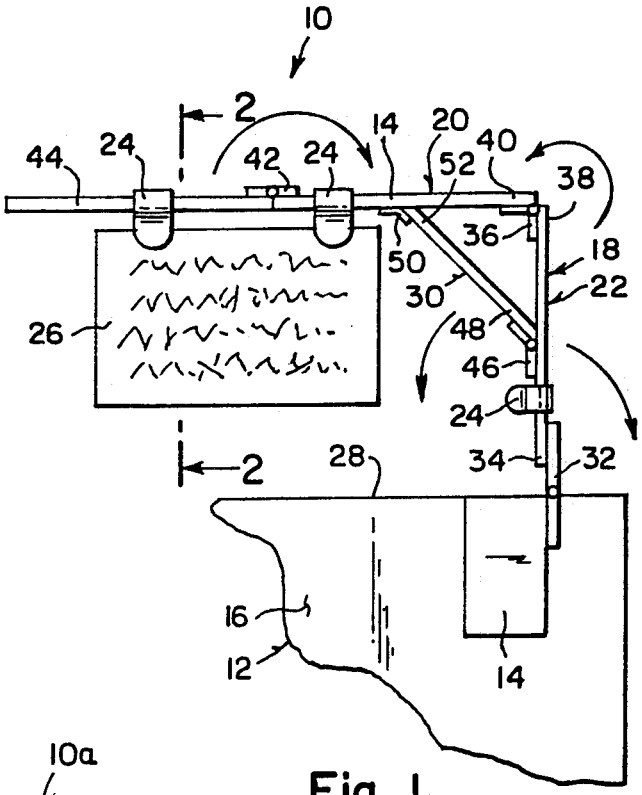
Fig. 1
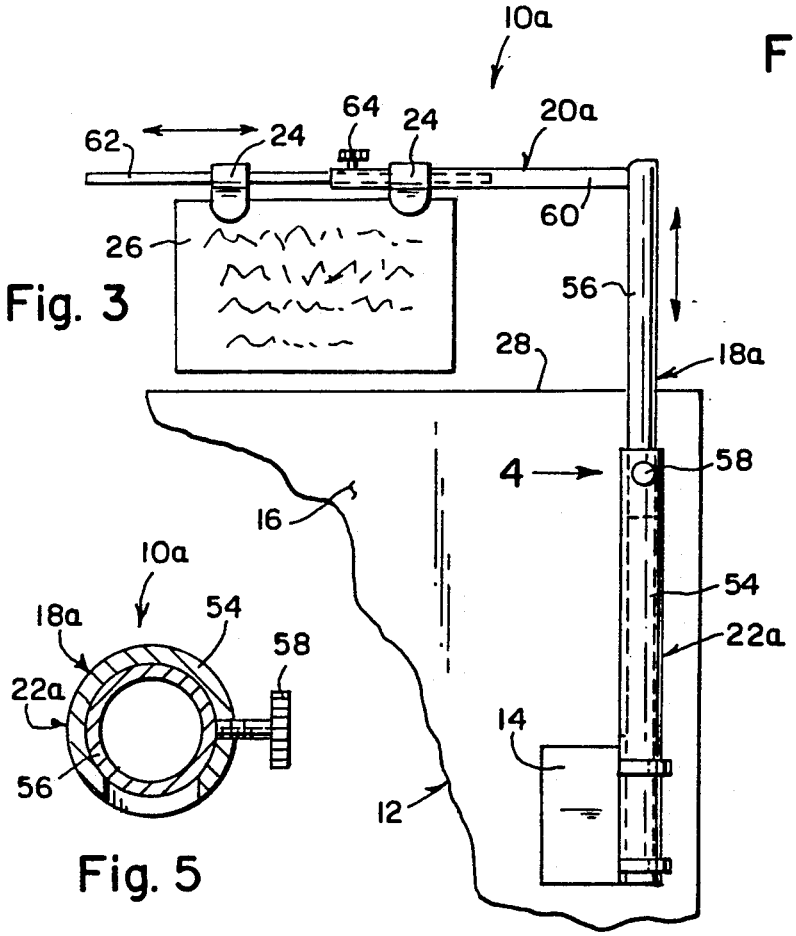
Fig. 3
Fig. 5
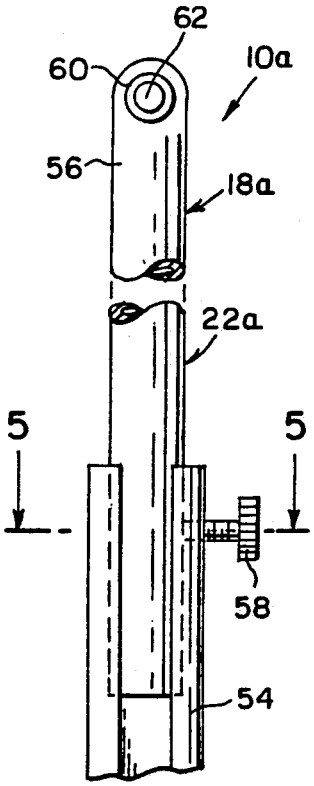
Fig. 4

INSTRUCTION CLIP FOR SEWING MACHINE

BACKGROUND OF THE INVENTION

The instant invention relates generally to holding devices and more specifically it relates to an instruction holder for a sewing machine cabinet.

Numerous holding devices have been provided in prior art that are adapted to adjustably support copy material thereto. For example, U.S. Pat. Nos. 152,226 to Hall; 728,613 to Price and 4,243,335 to Singley all are illustrative of such prior art. While these units may be suitable for the particular purpose to which they address, they would not be as suitable for the purposes of the present invention as heretofore described.

SUMMARY OF THE INVENTION

A primary object of the present invention is to provide an instruction holder for a sewing machine cabinet that will overcome the shortcomings of the prior art devices.

Another object is to provide an instruction holder for a sewing machine cabinet that will suspend an instruction sheet from a pattern envelope so that the hands of a person are free while sewing.

An additional object is to provide an instruction holder for a sewing machine cabinet that is suspended from rear portion of the cabinet so as to be adjusted horizonally and vertically therefrom.

A further object is to provide an instruction holder for a sewing machine cabinet that is simple and easy to use.

A still further object is to provide an instruction holder for a sewing machine cabinet that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is an elevational view of the invention mounted to rear of a sewing machine cabinet.

FIG. 2 is an enlarged cross sectional view taken along line 2—2 in FIG. 1, showing one of the clip members in greater detail.

FIG. 3 is an elevational view of a modified form of the invention being telescopically adjustable.

FIG. 4 is an enlarged side view with parts broken away taken in direction of arrow 4 in FIG. 3 showing the slot and set screw in greater detail.

FIG. 5 is a cross sectional view taken along line 5—5 in FIG. 4.

DETAILED DESCRIPTION OF THE PREFERRED EMBODIMENTS

Turning now descriptively to the drawings, in which similar reference characters denote similar elements throughout the several views, FIGS. 1 and 2 illustrates an instruction holder 10 for a sewing machine cabinet 12 consisting of a mounting block 14 is affixed to rear surface 16 of the sewing machine cabinet 12. An inverted L-shaped stanchion 18 is provided that has a horizontal arm 20 and a vertical arm 22 which is affixed to the mounting block 14. Clips 24 are for suspending an instruction sheet 26 from a pattern envelope on the horizontal arm 20 which extends over top surface 28 of the sewing machine cabinet 12, so that hands of a person (not shown) are free while sewing.

An angular brace support 30 extends between the horizontal arm 20 and the vertical arm 22 to keep the horizontal arm 20 in a secured position over the top surface 28 of the sewing machine cabinet 12. The inverted L-shaped stanchion 18 further includes a first hinge 32 disposed between bottom end 34 of the vertical arm 22 and the mounting block 14. A second hinge 36 is disposed between top end 38 of the vertical arm 22 and end 40 of the horizontal arm 20. A third hinge 42 is disposed on a upper surface between two segmented portions 44 of the horizontal arm 20. A fourth hinge 46 is disposed between lower end 48 of the angular brace support 30 and the vertical arm 18. A stop member 50 is disposed on underside of the horizontal arm 20 to engage with upper end 52 of the angular brace support 30. The inverted L-shaped stanchion 18 can be collapsed and folded upon itself in a stored position behind the rear surface 16 of the sewing machine cabinet 12.

FIGS. 3, 4 and 5 a modified instruction holder **10*a* wherein the inverted L-shaped stanchion 18*a* further includes the vertical arm 22*a* having a slotted support tube 54 with a support rod 56 to travel within the tube 54. A first set screw 58 is threaded into the tube 54 to engage with the rod 56 so that the rod 56 may be raised and lowered and held by the first set screw 58 thus making the vertical arm 22*a*** adjustable.

The horizontal arm **20*a* has a support sleeve 60 extending at a right angle from the rod 56 with a support bar 62 to travel within the sleeve 60. A second set screw 64 is threaded into the sleeve 60 to engage with the bar 62 so that the bar 62 may be extended and retracted and held by the second set screw 64 thus making the horizontal arm 20*a*** adjustable.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An instruction holder for a sewing machine cabinet which comprises:

(a) a mounting block affixed to rear surface of the sewing machine cabinet;

(b) an inverted L-shaped stanchion having a horizontal arm and a vertical arm having center lines defining a vertical plane said vertical arm is affixed to said mounting block;

(c) at least one clip for suspending an instruction sheet from a pattern envelope on said horizontal arm which extends over top surface of the sewing machine cabinet, so that hands of a person are free while sewing;

(d) an angular brace support extending between said horizontal arm and said vertical arm to keep said horizontal arm in a secured position over the top surface of the sewing machine cabinet;

(e) a first hinge disposed between bottom end of said vertical arm and said mounting block, having means for pivoting said vertical arm rearward aligned with said vertical plane;

(f) a second hinge disposes between top end of said vertical arm and an end of said horizontal arm; adapted to pivot inwardly along said vertical plane (g) a third hinge disposed on an upper surface between two segmented portions of said horizontal arm;

(h) a fourth hinge disposed between lower end of said angular brace support and said vertical arm; between the first and second said hinges;

(i) a stop member disposed on the underside of said angular brace support between the second and third said hinges so that said inverted L-shaped stanchion can be collapsed and folded upon itself in a stored position behind the rear surface of the sewing machine cabinet.

* * * * *